US009756919B2

(12) United States Patent
Murdoch et al.

(10) Patent No.: US 9,756,919 B2
(45) Date of Patent: Sep. 12, 2017

(54) METHOD FOR ATTACHING A CARRIER TO A PIECE OF ROLLING LUGGAGE

(71) Applicant: THINK TANK PHOTO, INC., Santa Rosa, CA (US)

(72) Inventors: Douglas Harland Murdoch, Santa Rosa, CA (US); Michael Allen Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 14 days.

(21) Appl. No.: 14/809,255

(22) Filed: Jul. 26, 2015

(65) Prior Publication Data

US 2016/0022003 A1 Jan. 28, 2016

Related U.S. Application Data

(62) Division of application No. 13/914,606, filed on Jun. 10, 2013, now abandoned.

(60) Provisional application No. 61/657,884, filed on Jun. 10, 2012.

(51) Int. Cl.

| | |
|---|---|
| ***A45C 13/30*** | (2006.01) |
| ***A45C 5/14*** | (2006.01) |
| ***A45F 3/02*** | (2006.01) |
| *A45C 9/00* | (2006.01) |
| *A45C 13/02* | (2006.01) |
| *A45F 3/12* | (2006.01) |

(52) U.S. Cl.

CPC ..... *A45C 13/30* (2013.01); *A45C 5/14* (2013.01); *A45F 3/02* (2013.01); *A45C 2009/007* (2013.01); *A45C 2013/026* (2013.01); *A45C 2013/306* (2013.01); *A45F 3/12* (2013.01)

(58) Field of Classification Search

CPC ..... A45C 5/14; A45C 7/0045; A45C 13/30; A45C 2013/306; A45F 2003/142

USPC ..... 190/18 A, 100, 108

See application file for complete search history.

(56) References Cited

U.S. PATENT DOCUMENTS

| | | | | |
|---|---|---|---|---|
| 2,707,035 | A * | 4/1955 | Lashley | A45C 5/00 190/108 |
| 4,350,132 | A | 9/1982 | Harsch et al. | |
| 4,431,041 | A | 2/1984 | Leiserson | |
| 4,538,709 | A | 9/1985 | Williams et al. | |
| 4,759,431 | A | 7/1988 | King et al. | |
| 5,355,980 | A | 10/1994 | Hsieh | |
| 5,515,954 | A | 5/1996 | Nordstrom | |
| 5,699,886 | A * | 12/1997 | Latshaw | A45C 13/262 190/108 |
| 5,713,439 | A | 2/1998 | Zionts et al. | |
| 5,762,170 | A | 6/1998 | Shyr et al. | |
| 5,813,503 | A | 9/1998 | Chang | |
| 5,893,495 | A * | 4/1999 | Godshaw | A45F 3/04 190/115 |
| 5,941,195 | A | 8/1999 | Martz | |
| 5,943,936 | A | 8/1999 | Deliman et al. | |
| 5,950,893 | A | 9/1999 | Heggeland | |
| 6,021,740 | A | 2/2000 | Martz | |
| 6,109,404 | A | 8/2000 | Bishop | |
| 6,260,680 | B1 | 7/2001 | Lin | |

(Continued)

*Primary Examiner* — Sue A Weaver

(74) *Attorney, Agent, or Firm* — R. Dabney Eastham

(57) ABSTRACT

A method for attaching a carrier to a piece of rolling luggage employs a strap having an opening defined in the strap for receiving a handle assembly of the piece of rolling luggage in order for the carrier to be supported by the piece of rolling luggage.

11 Claims, 4 Drawing Sheets

(56) References Cited

U.S. PATENT DOCUMENTS

| | | | | |
|---|---|---|---|---|
| 6,666,363 | B2 | 12/2003 | Godshaw et al. | |
| 7,431,311 | B2 | 10/2008 | Turner et al. | |
| 8,936,140 | B2 * | 1/2015 | Herold | A45C 5/14 190/108 |
| 2003/0141684 | A1 | 7/2003 | Edwards | |
| 2003/0160078 | A1 * | 8/2003 | Godshaw | A45F 3/14 224/607 |
| 2003/0188943 | A1 | 10/2003 | Freedman | |
| 2004/0026199 | A1 | 2/2004 | Chen | |
| 2005/0077133 | A1 | 4/2005 | Cassegrain | |
| 2006/0070901 | A1 | 4/2006 | Adams et al. | |
| 2006/0086583 | A1 | 4/2006 | Hoberman et al. | |
| 2006/0118376 | A1 | 6/2006 | Godshaw et al. | |
| 2006/0260893 | A1 | 11/2006 | Drew et al. | |
| 2006/0266604 | A1 | 11/2006 | Chou | |
| 2007/0089952 | A1 | 4/2007 | Herbst et al. | |
| 2007/0228096 | A1 | 10/2007 | Lin | |
| 2008/0251341 | A1 | 10/2008 | Murdoch et al. | |
| 2009/0159385 | A1 | 6/2009 | Poissant et al. | |
| 2009/0183961 | A1 | 7/2009 | Whalen et al. | |
| 2009/0223765 | A1 | 9/2009 | Bosma | |
| 2010/0108452 | A1 | 5/2010 | Williams et al. | |
| 2011/0139560 | A1 | 6/2011 | Via | |

* cited by examiner

METHOD FOR ATTACHING A CARRIER TO A PIECE OF ROLLING LUGGAGE

CROSS-REFERENCE TO RELATED APPLICATION

This non-provisional application is a division of pending U.S. non-provisional application Ser. No. 13/914,606 filed on Jun. 10, 2013 and titled "WHEELED CARRIER AND STRAP," the contents of which are incorporated by reference for all purposes. U.S. non-provisional application Ser. No. 13/914,606 claimed benefit and priority under 35 U.S.C. §119(e) of U.S. provisional patent application Ser. No. 61/657,884, filed on Jun. 10, 2012 and titled "WHEELED CARRIER AND STRAP," the contents of which are incorporated by reference for all purposes.

FIELD OF THE INVENTION

The field of the invention generally is that of wheeled carriers for articles and straps for carriers.

BACKGROUND OF THE INVENTION

People want carriers that enable them to transport articles without excessive effort. Pieces of rolling luggage commonly have wheeled receivers with an interior compartment for containing articles. The wheels support the weight of the luggage and its contents. The user pulls a handle attached to the receiver in order to move the piece of rolling luggage while the wheels support its weight. The handle usually is part of a telescoping handle assembly that can be retracted into the receiver. An opening on one side or other of the receiver provides access to the interior compartment. The opening is closed by a door or panel, usually by a zipper but sometimes buckles by or clasps.

The receivers of existing pieces of rolling luggage lack adequate access to the interior compartment. In addition, the interior compartment should be as large as possible in order to accommodate large articles when the size of the receiver is limited, such as by the need to satisfy carry-on luggage size requirements.

A person often will travel with two carriers, bags, or pieces of luggage, at least one of them being a piece of rolling luggage. In that case the person will want to be able to use the at least one piece of rolling luggage to carry the other carrier, bag or piece of luggage so the user may pull both pieces by one handle. Various expedients have been used to attach a bag, carrier, or piece of luggage to the piece of rolling luggage, such as using elastic cord or by wrapping a shoulder strap around the handle of the piece of rolling luggage, but the attachments are often insecure or require additional equipment that has no other purpose.

SUMMARY OF THE INVENTION

According to the invention, the problem of providing a more secure attachment of a carrier, bag, or piece of luggage to a piece of rolling luggage having a handle is solved by providing a strap for connection to the carrier, bag, or piece of luggage and having an opening between its points of connection to the carrier, bag, or piece of luggage, and inserting the handle of the piece of rolling luggage through the opening so the strap supports the carrier, bag, or piece of luggage from the piece of rolling luggage. In an aspect of the invention, the strap is a shoulder strap that is bifurcated in at least a part of the shoulder strap to form an opening to receive the handle of the piece of rolling luggage in order to attach the carrier, bag, or piece of luggage to the piece of rolling luggage.

DESCRIPTION OF THE DRAWINGS

Other objects, features, and advantages of the present invention will become more fully apparent from the following detailed description of preferred embodiments, the appended claims, and the accompanying drawings in which:

DETAILED DESCRIPTION OF PREFERRED EMBODIMENTS

Figure 1:
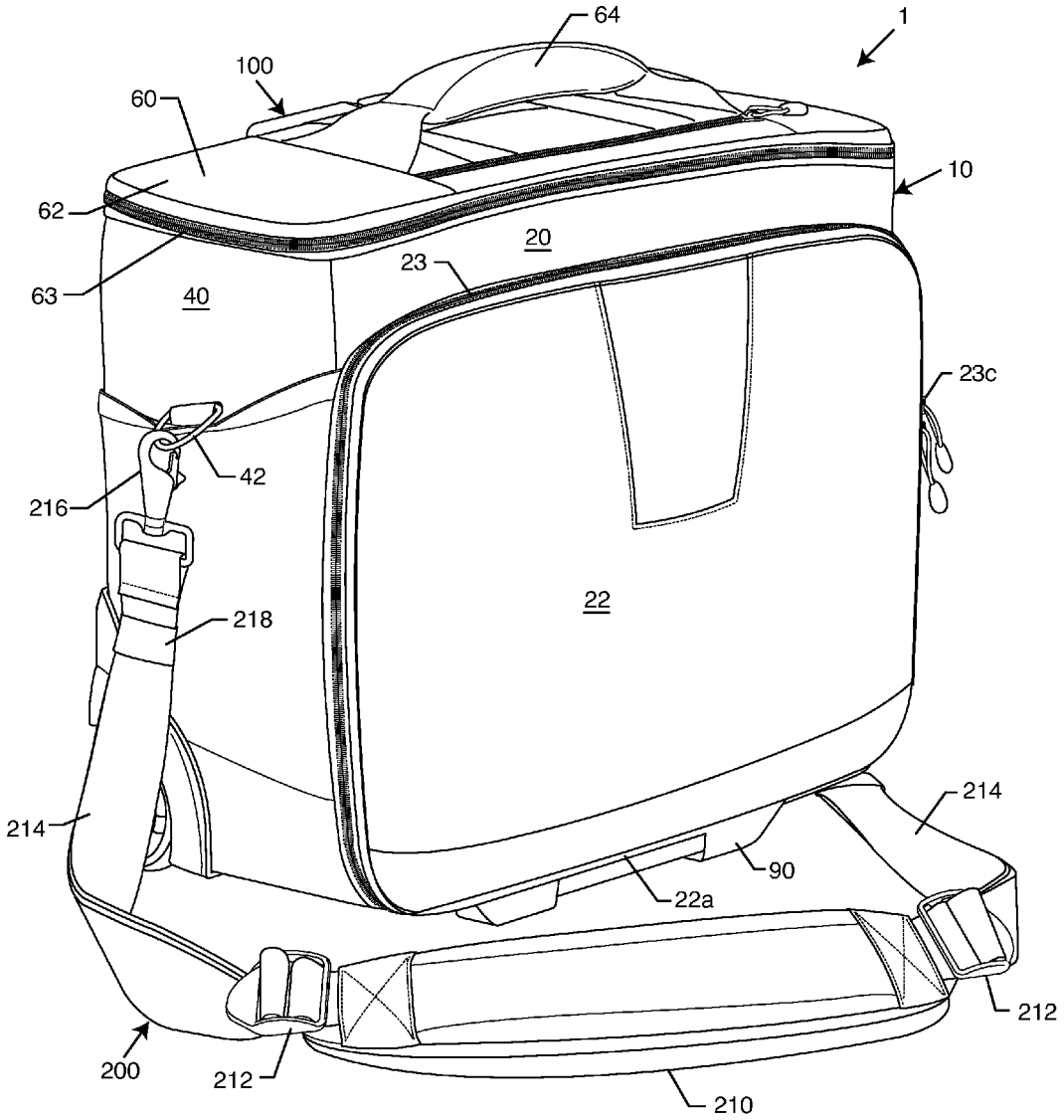
FIG. 1 is a perspective view from the right and front side of an embodiment of a wheeled carrier according to the invention with the top and front doors or panels zipped to the receiver of the carrier and the handle assembly is retracted to a closed configuration.

Referring now to the drawings, a preferred embodiment of a wheeled carrier according to the invention is indicated generally by reference numeral 1. The wheeled carrier shown in the drawings is in the form of a pilot's bag, also known as a flight bag or aviator bag, and is provided with wheels and a telescoping or slidingly extending handle assembly. The size and shape of the wheeled carrier, however, could be varied and still be within the scope of the invention.

The piece of rolling luggage 1 comprises three components: a receiver 10, a handle assembly 100, and a shoulder strap 200, as described in more detail below.

The receiver 10 has a front wall 20, a back wall 30, a right side wall 40, a left side wall 50, a top wall 60, and a bottom wall 70 generally joined at their edges to define a generally rectangular parallelepiped-shaped interior compartment 12. The front wall 20, the back wall 30, the right side all 40, and the left side wall 50 may generally be referred to as the "side walls" of the receiver 10 because they join the top wall 60 to the bottom wall 70. The back wall 30 is the wall that is adjacent to the handle assembly 100 and preferably is attached to the handle assembly 100. The front wall 20 is the wall spaced from and parallel to the back wall 30.

The walls 20, 30, 40, 50, 60, and 70 are preferably made of a strong and abrasion resistant fabric, such as polyester oxford cloth, coated on an interior side for water resistance, and further provided with padding or similar stiffening elements in order to give shape to the receiver 10. Padding would provide some protection to the contents of the receiver 10 from dropping and other blows.

The receiver 10 is provided with two wheel assemblies 80. Each wheel assembly 80 comprises a wheel 82 mounted on an axle attached to a wheel housing 84. The wheel assemblies 80 are each attached to the exterior of the bottom wall 70, the back wall 30, and one of the right side wall 40 and the left side wall 50 so that the wheels 82 generally share a common axis. The wheel housings 84 each comprise an interior portion and an exterior portion mounted on either side of the bottom wall 70, the back wall 30, and one of the right side wall 40 and the left side wall 50.

Figure 2:
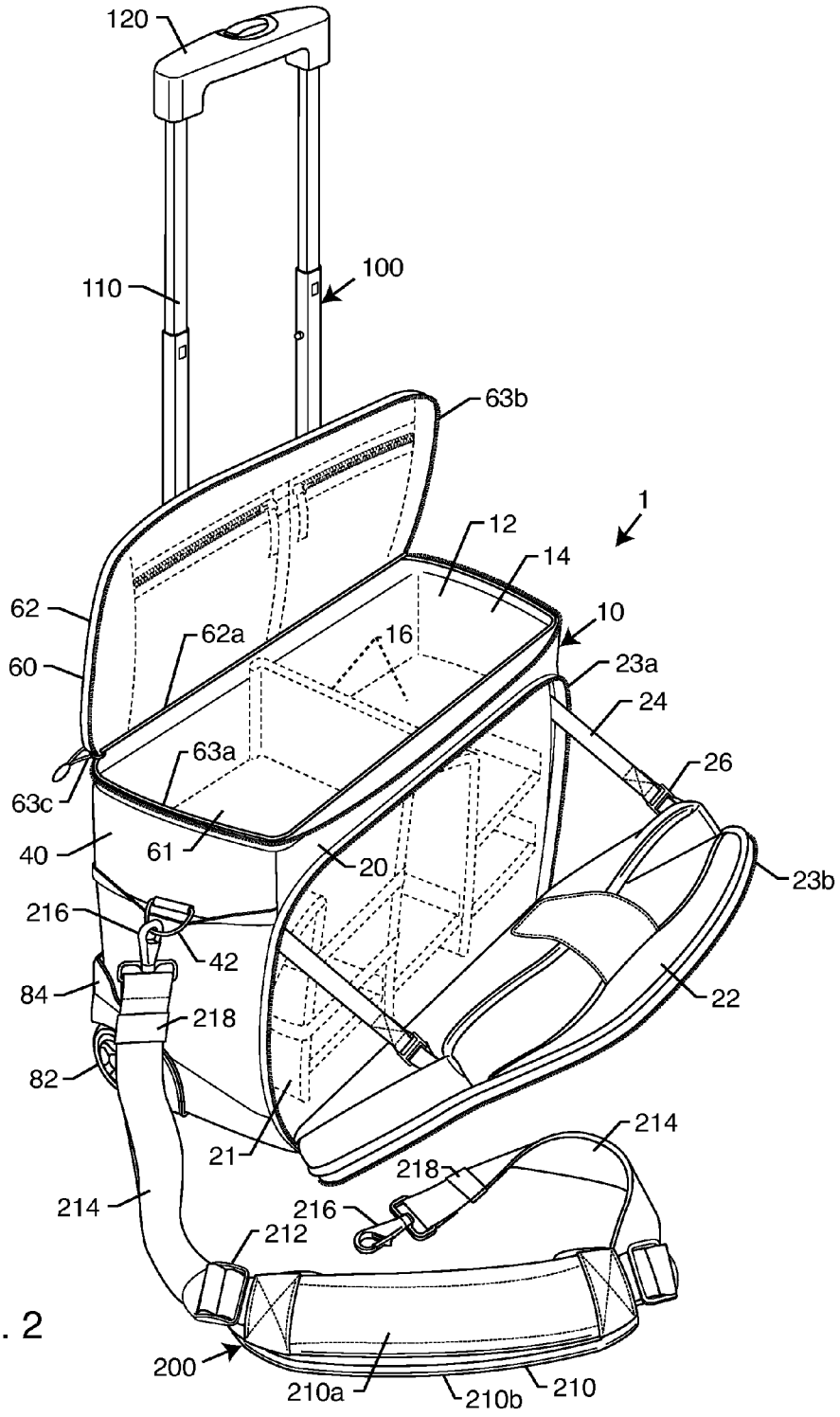
FIG. 2 is a perspective view from the right and front side of the embodiment of a wheeled carrier shown in FIG. 1 wherein the handle assembly is deployed in an extended configuration and the top and front doors or panels are unzipped from the receiver or body of the carrier and rotated away from the top and front openings to the interior compartment formed in the receiver of the carrier.
Figure 3:
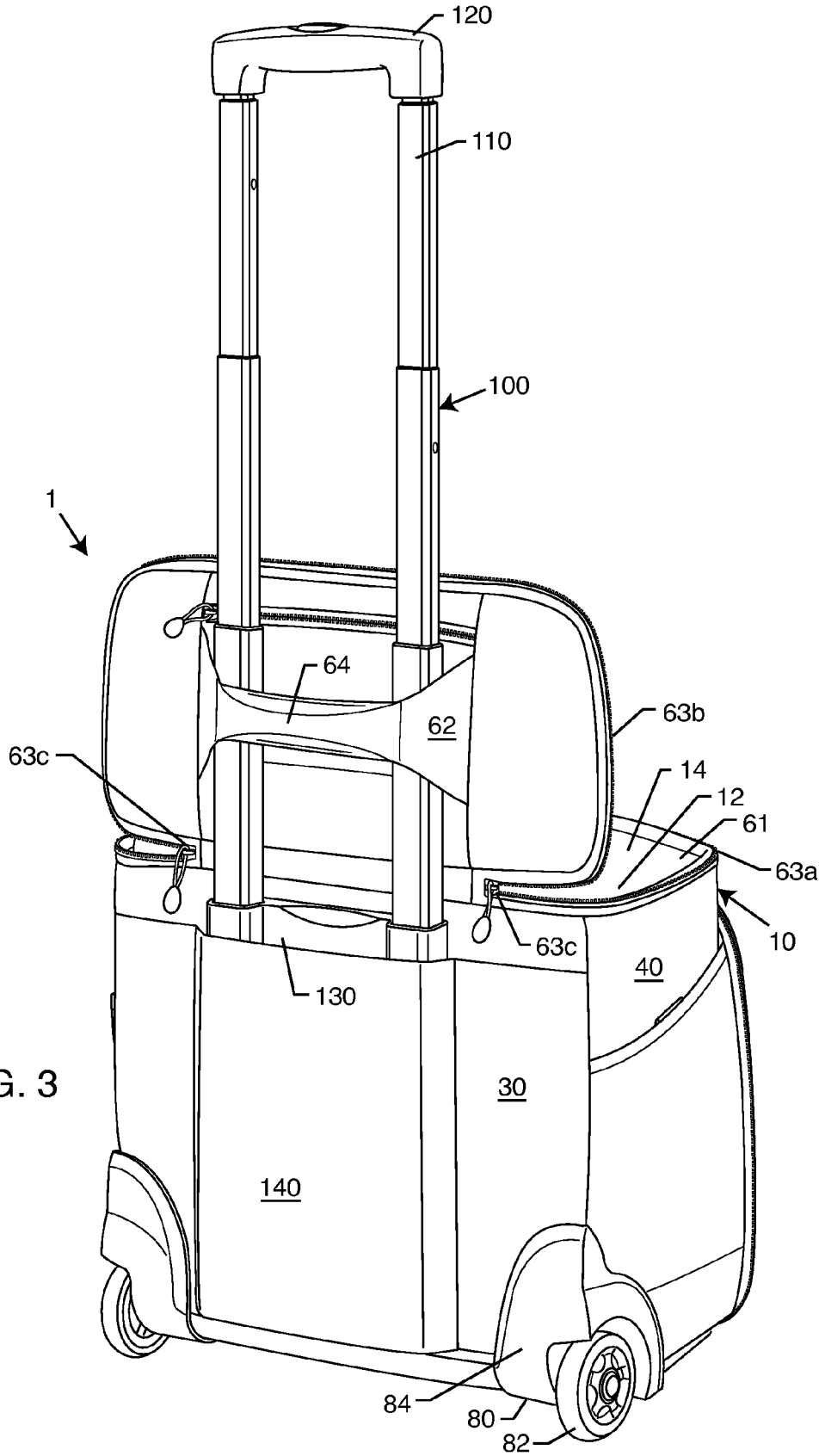
FIG. 3 is a perspective view from the rear and right side of the embodiment of a carrier shown in FIG. 1 with the handle assembly deployed in the extended configuration and the top door or panel unzipped and rotated away from the top opening to the compartment of the receiver of the carrier.

The wheels 82 and the foot 90 will support the receiver 10 in an upright position as shown in FIGS. 1-3.

The interior portions of the wheel housings 84 also are mounted over a sheet (not shown) that is positioned against the interior of the back wall 30 and the bottom wall 70. The sheet is preferably made of polyethylene and provides rigidity and shape to the receiver 10. As discussed below, it will connect to the handle assembly 100.

Rivets and/or screws join the interior and exterior portions of the wheel housings 84 through the bottom wall 70, the back wall 30, the polyethylene sheet, and one of the right side wall 40 and the left side wall 50. Rivets or screws also join the foot 90 through the bottom wall 70 to the polyethylene sheet.

The receiver 10 has two openings 21 and 61 that each permit access to the same interior compartment 12, as is shown in FIG. 2. A front opening 21 accesses the compartment 12 through the front wall 20. A front door or panel 22 closes the front opening 21 when the zipper halves 23*a* and 23*b* of the zipper 23 are joined by moving the zipper sliders 23*c*. The front door 22 is attached to the bottom wall 70 by a hinge 22*a* so that the front door 22 may rotate away and down from the front wall 20 to expose the opening 21. The retainer straps 24 hold the door 22 partly open but may be disconnected from the door 22 by unfastening the buckles 26.

A top opening 61 accesses the compartment 12 through the top wall 60. A top door 62 closes the top opening 61 when the zipper halves 63*a* and 63*b* of the zipper 63 are joined by moving the zipper sliders 63*c*. The top door 62 is attached to the back wall 30 by a hinge 62*a* so that the top door 62 may rotate away and down from the top wall 60 to expose the opening 61. As shown in FIG. 2, the top door 62 essentially is the same as the top wall 60 but this is not required.

As an example of the usefulness of having top and side openings in the same wheeled carrier, consider the benefit to a photographer of being able to reach into the top opening 61 of the wheeled carrier 1 while that wheeled carrier 1 is positioned upright as shown in FIGS. 1-3. The photographer may have a camera stored in an upper part of the compartment 12, just below the top door 62, where she can easily reach it if needed to take a picture quickly. Alternatively, gear may be stored in a lower part of the compartment 12 that does not need to be available so quickly. The photographer then will have the time to turn the receiver 10 so that its front wall 20 is uppermost and thus gain access to the front door 22 and the front opening 21 without the worry of articles falling out of the interior compartment 12.

A padded tub insert 14 preferably is provided to give more protection to the contents of the compartment from shocks and jostling. It is sized and shaped to fit against the back wall 30, the bottom wall 70, and the right and left side walls 40 and 50*b*. Openings are defined in the padded tub insert 14 that align with and correspond to the openings 21 and 61 defined in the receiver 10.

The padded tub insert 14 preferably is made of foam padding contained in a fabric envelope. The fabric envelope preferably is made of a knitted fabric, at least on the side that faces the interior of the compartment 12, in order to permit the attachment of the optional movable dividers 16 by means of hook strips attached to the ends and sides of the dividers 16. Providing the dividers 16 is useful, for example, to position and contain articles useful for photographers within the interior compartment 12.

The padded tub insert 14 is removable and therefore may be replaced. It is connected to the side walls 40 and 50 and the bottom wall 70 by hook and loop strips (not shown) and is fastened to the right and left side walls 40 and 50*b* and the back wall 30 by a zipper (not shown) running under the edge of the opening 61.

A removable padded tub insert for a wheeled luggage is described in the present inventors' U.S. Pat. No. 8,123,007, the disclosure of which is incorporated by reference for all purposes permitted by law and regulation, at column 8, line 65 to column 9, line 37. The padded tub insert 14 used in the receiver 10 of the wheeled carrier 1 of this specification, however, does not separate the interior compartment 12 into two subcompartments.

The receiver 10 contains a handle assembly 100. It comprises two telescoping arms 110 joined by a handle 120. The telescoping arms 110 comprise three tubes with rectangular cross-sections of varying size that permit the larger to overlap the smaller to allow the tubes to slide back and forth with respect to each other. The handle 120 has a button that the user may depress to unlock the telescoping arms 110 in order to collapse them from the extended configuration shown in FIGS. 2 and 3, in which the arms 110 extend above the top wall 60, to the contracted configuration shown in FIGS. 1 and 4, in which the arms 110 do not extend above the top wall 60.

The telescoping arms 110 also are held together by the cross bars 130, one of which is shown in FIG. 3. The cross arms 130 are connected to the outer side of the back wall 30 by rivets or bolts that join the cross arms 130, the back wall 30, and the frame sheet on the other side of the back wall 30.

Being placed on the outer side of the back wall 30 rather than the inner side permits fuller use of the compartment 12 for storing various items because the handle assembly 100 will not be inside the receiver 10. The handle assembly 100 also is exposed on the exterior of the receiver 10 where it is liable to wear and damage. A shield 140 is provided in the form of a molded sheet, preferably made of acrylonitrile butadiene styrene (ABS). The shield 140 is adhered or sewn to the back wall 30. Preferably, the shield 140 will cover and protect the handle assembly 100 when it is in the contracted configuration shown in FIGS. 1 and 4.

Figure 4:
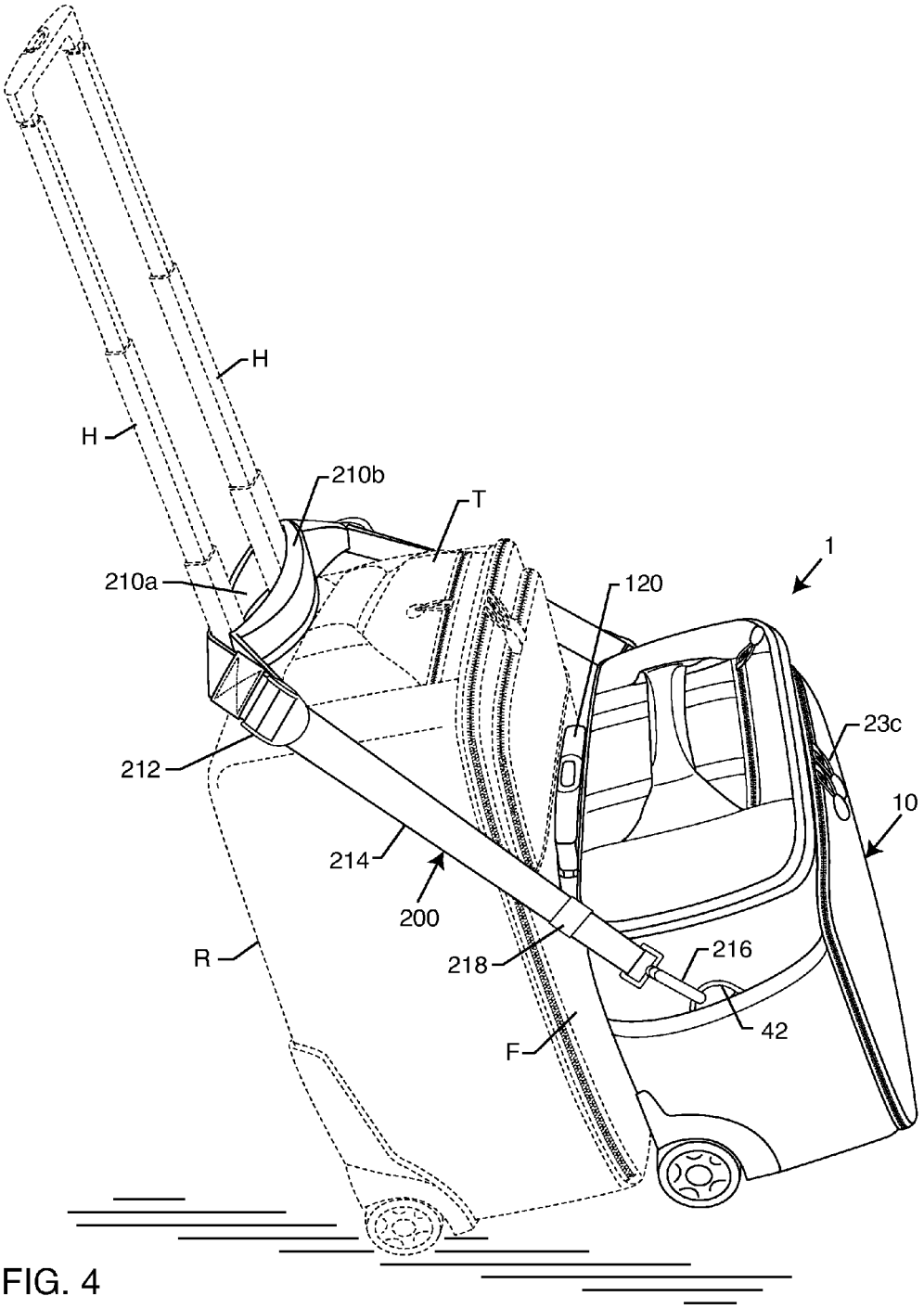
FIG. 4 is a perspective view from the right and front side of the embodiment of the carrier shown in FIG. 1 supported on another wheeled carrier by its shoulder strap engaging the handle of the other rolling luggage.

The rolling luggage 1 is provided with a shoulder strap 200 (shown in FIGS. 1, 2, and 4) that permits it to be suspended from the shoulder of the user. For that purpose it comprises a central section 210 that is padded for comfort. The central portion comprises two portions 210*a* and 210*b* that are sewn to each other only at their respective ends so that the portions 210*a* and 210*b* may be separated from each other at the points where they are not attached. As shown in FIG. 4 and described in more detail below, an object may be inserted between the portions 210*a* and 210*b*. The portion 210*b* is more thickly padded and should be the portion that comes in direct contact with the shoulder of the user. The portion 210*a* need not be padded as much as the portion 210*b* or at all.

The central section 210 is attached by sewn loops to the ladder lock buckles 212. The ladder lock buckles 212 receive the straps 214, which are preferably made of webbing, and are fitted through two apertures in the corresponding ladder lock buckle 212. One end of each strap 214 is attached to a snap hook 216 by folding a portion around the ring of the snap hook 216 and sewing the end of that portion to the strap. The snap hooks 216 connect the shoulder strap 200 to the receiver 10 by being attached to the D rings 42 and 52 on straps sewn on the right and left side walls 40 and 50, respectively. The shoulder strap 200 may be detached from the receiver 10 by opening the snap hooks 216 in order to disconnect them from the D-rings 42 and 52.

The length of portion of each of the straps 214 may be adjusted by sliding the strap 214 through the ladder lock buckle 212 to the degree desired by the user. A keeper ring 218 secures the loose end of the strap 214. The keeper ring 218 is made of a piece of an elastic fabric and is sewn to itself. It fits around the strap 214 and is free to move along the strap 214 as desired by the user.

A traveler often will have more than one carrier to transport. If one of the pieces is a wheeled carrier, it may be used to support the other carrier so that the traveler can tow both pieces at once with one hand.

FIG. 4 shows how the shoulder strap 200 may be used to connect the wheeled carrier 1 to another wheeled carrier, designated as "R" in FIG. 4. The user may connect the shoulder strap 200 to the handle "H" of the wheeled carrier R by sliding the handle H between the portions 210*a* and 210*b*. The length of the straps 214 between the slider buckles 212 and the snap rings 216 may need to be adjusted to have the wheeled carrier 1 fit next to the front wall "F" of the rolling luggage R or on the top wall "T" of the rolling luggage R (not shown). The shoulder strap 200 permits an easy and secure attachment of the wheeled carrier 1 to the wheeled carrier R and will replace a variety of expedients currently used for attaching one carrier to another.

While the invention has been described in conjunction with the preferred embodiment, it will be understood that it is not intended to limit the invention to this embodiment or its particular manner of construction, materials or components. On the contrary, the invention is intended to cover alternatives, modifications and equivalents that may be included within the spirit and scope of the invention as defined by the appended claims.

What is claimed is:

1. A method for attaching a carrier to a piece of rolling luggage, wherein the piece of rolling luggage comprises a receiver comprising an extendible handle assembly and wheels whereby the piece of rolling luggage may be drawn by a person across a surface by pulling on the handle assembly, comprising:

providing a shoulder strap for connection to two separated points on the carrier, the shoulder strap comprising a central section comprising two portions attached to each other at their respective ends thereby defining an opening between the two portions;

inserting the handle assembly of the piece of rolling luggage through the opening in the shoulder strap by inserting the handle assembly between the two portions of the central section of the shoulder strap; and suspending the carrier so that the carrier is supported by the strap.

2. The method according to claim 1 wherein the length of the shoulder strap is adjustable in length.

3. The method according to claim 2 wherein the shoulder strap comprises straps passing through slider buckles for adjustment of the length of the shoulder strap.

4. The method according to claim 2 wherein the length of the shoulder strap is adjustable in length so that the carrier may be suspended so that the carrier is supported in contact with a front wall of the piece of rolling luggage opposed to a back wall of the piece of rolling luggage adjacent the handle assembly and wheels of the piece of rolling luggage.

5. The method according to claim 1 wherein at least one of the portions is padded.

6. The method according to claim 5 wherein both portions are padded.

7. The method according to claim 1 wherein the two portions are sewn to each other at their respective ends.

8. The method according to claim 7 wherein the two portions are sewn at their respective ends to two opposed straps.

9. The method according to claim 8 wherein at least one of the straps is provided with a buckle for adjusting the length of the strap.

10. The method according to claim 8 wherein each of both straps is provided with a buckle for adjusting the length of the strap.

11. The method according to claim 8 wherein the straps are provided with snap hooks for attachment to the two separated points on the carrier.

* * * * *